US005787898A

United States Patent [19]

Freimann

[11] Patent Number: 5,787,898

[45] Date of Patent: Aug. 4, 1998

[54] BACKACHE RELIEF EXERCISING METHOD

[76] Inventor: Daniel Freimann, 52 Nahalat Benjamin St., Tel Aviv 65154, Israel

[21] Appl. No.: 664,831

[22] Filed: Jun. 17, 1996

[51] Int. Cl.[6] ..... H61B 19/00

[52] U.S. Cl. ..... 128/898; 601/1; 601/5; 601/23; 601/39; 482/67; 482/69; 482/148; 482/907

[58] Field of Search ..... 128/898; 482/67, 482/69, 121, 124, 131, 148, 907; 135/65, 68–73; 601/1, 5, 23, 33, 39

[56] References Cited

U.S. PATENT DOCUMENTS

| | | | |
|---|---|---|---|
| 4,325,547 | 4/1982 | Cook | 482/142 |
| 5,224,924 | 7/1993 | Urso | 602/19 |
| 5,456,649 | 10/1995 | Horkey | 482/39 |
| 5,540,643 | 7/1996 | Fontaine | 482/143 |
| 5,637,079 | 6/1997 | Miller | 602/36 |

OTHER PUBLICATIONS

Manniche et al. "Intensive dynamic back exercises for chronic low back pain: a clinical trial." Pain 47(1):53–63, Oct. 1991.

Khalil et al. "Stretching in the rehabilitation of low–back pain patients." Spine 17(3):311–7, Mar. 1992.

*Primary Examiner*—Aaron J. Lewis

*Assistant Examiner*—Kelly O'Hara

[57] ABSTRACT

An exercising method for stretching the spinal column and strengthening the spinal muscles. The user suspends his body on crutch-like supports and performs a series of exercises by positioning his body and/or the crutches in various angular positions relative to the floor. The crutches may be conventional crutches, or crutches which extend to a level higher than the user's shoulders, straps being provided for holding the body in suspension by the armpits.

7 Claims, 5 Drawing Sheets

BACKACHE RELIEF EXERCISING METHOD

BACKGROUND OF THE INVENTION

The present invention relates to an exercising method particularly aiming to relief and even avoid lower backaches.

The generic term "lower backaches" is popularly applied to pains resulting out of the excessive proximation of adjacent vertebrae, particularly in the lumbar area. In extreme cases, such proximity causes the fracture of the cartilaginous material between the vertebrae ("the discus"), resulting contact with and pressure on—adjacent nerves of the spinal cord. Surgical intervention is often required to remedy the traumatic and most painful condition of such patients.

Chiropractors and physical therapists strongly advice to exercise the lower spine, in order to improve the inter-vertebra flexion-extension range of their joints, and to strengthen the surrounding muscles; stronger muscles will protect the spinal column by taking some of the loads otherwise carried directly by the spinal vertebrae, and thus help to keep them apart from each other as desirable.

One sort of such recommended exercises are those which apply tension or stretching forces to the spinal column, simultaneously with or in addition to bending and torsion postures.

One way of achieving this goal is the use of horizontal bars (as in gymnastics). The exerciser is expected to hold the bar by his hands and hang himself down. His weight will thus provide the stretching force requested. Another way, practiced only under medical supervision in hospitals, is to stretch the patient's body by hanging weights down his legs.

The horizontal bars method suffers many disadvantages. The mounting or installation of a horizontal bar, and at a sufficient height, in ordinary apartments is most inconvenient if not ruled out altogether. And then, these exercises are clearly impracticable for elderly people. The number of variations allowed is poor, rendering the exercising boring and nonstimulating.

It is therefore the prime object of the present invention to provide a convenient and versatile exercising method for backache suffering patients which is based on the utilization of their own weight.

It is a further object of the invention to provide a method of spinal column therapeutic and fitness preservation, using a pair of ordinary, or modified, crutches.

SUMMARY OF THE INVENTION

According to the invention there is provided a human exercising method particularly for stretching the spinal column and strengthening the spinal muscles comprising of suspending the body on crutch-like supports, and varying the relative angular positions of the supports and the body.

The exercises may be performed with ordinary, cripple-type crutches, or with crutches which extend to a level higher than the user's shoulders, straps being provided for holding the body in suspension by the armpits.

BRIEF DESCRIPTION OF THE DRAWINGS

The invention is exemplified in the following description, considered along with the accompanying drawings, wherein.

DETAILED DESCRIPTION OF THE PREFERRED EMBODIMENT

Figure 1:
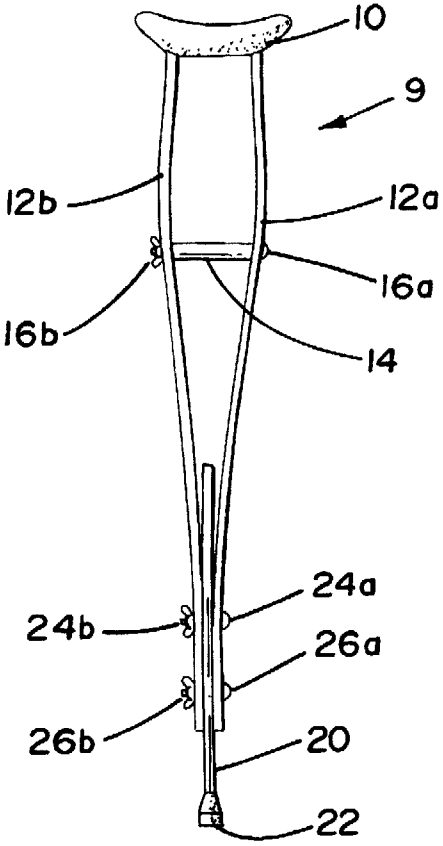
FIG. 1 shows a typical crutch as commonly used by leg injured persons or the crippled.

FIG. 1 shows a conventional underarm crutch 9 comprising an arm-pit rest 10, a pair of uprights **12*a* and 12*b* between which a hand-grip crosspiece 14 is adjustably installed by a pin 16*a* and butterfly-nut 16*b*. The uprights 12*a* and 12*b* are mounted to crutch support leg 20 with a rubber ferrule 22. The crutch 9 is adjustable by suitable location of the leg 20 relative to the uprights 12*a* and 12*b*, using the pins 24*a*, 26*a* and butterflies 24*b*, 26*b***, respectively.

Figure 2:
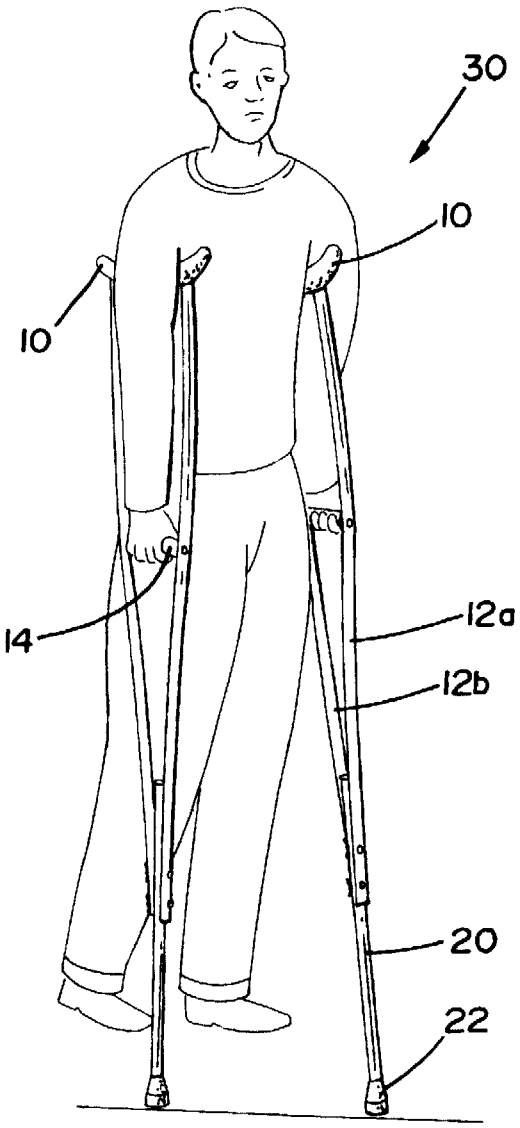
FIG. 2 illustrates the conversion of a pair crutches of FIG. 1 into an exercising tool according to the teachings of the present invention.

In order to function as prescribed by the method of this invention, the user, denoted 30 in FIG. 2, has first to adjust the location of the hand-grips 14 relative to the arm pit rest 10, as well as of overall height of the crutch, so that he can, by supporting his armpits with his arms straightened, lift himself to the suspended position of FIG. 2 (preferably with his toes reaching the floor, for stabilization).

Figure 3:
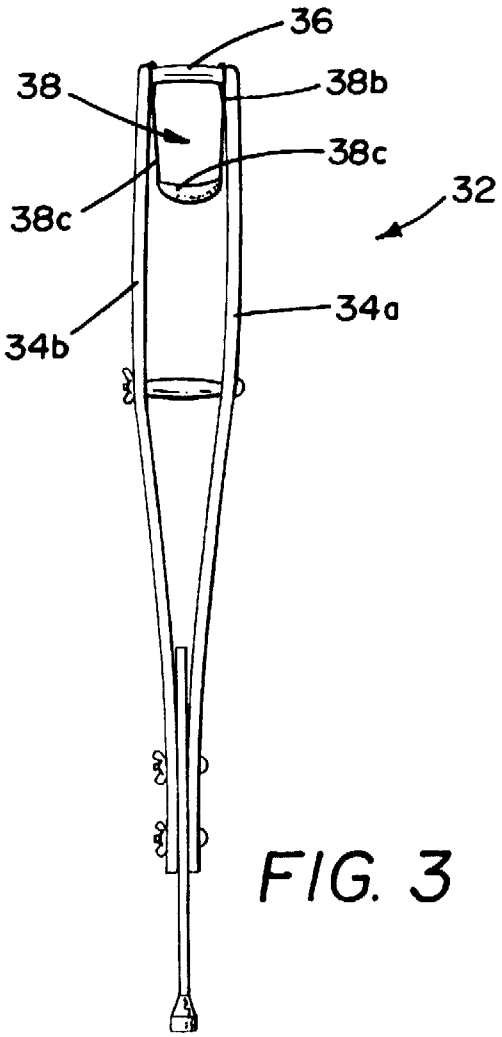
FIG. 3 shows an alternative design of a crutch useful for the purposes of the present invention.

The modified crutch 32 of FIG. 3 differs from the conventional crutches in that the user's arm-pits are suspended from above—rather than supported from below. To this end, uprights **34*a*, 34*b* are extended upwards, to form an overhanging arch or bow section 36. A strap 38 is provided, with a padded, preferably suede leather portion 38*a*, and a pair of ropes or the like 38*b* and 38*c* connected to the bow section 36**.

Figure 4:
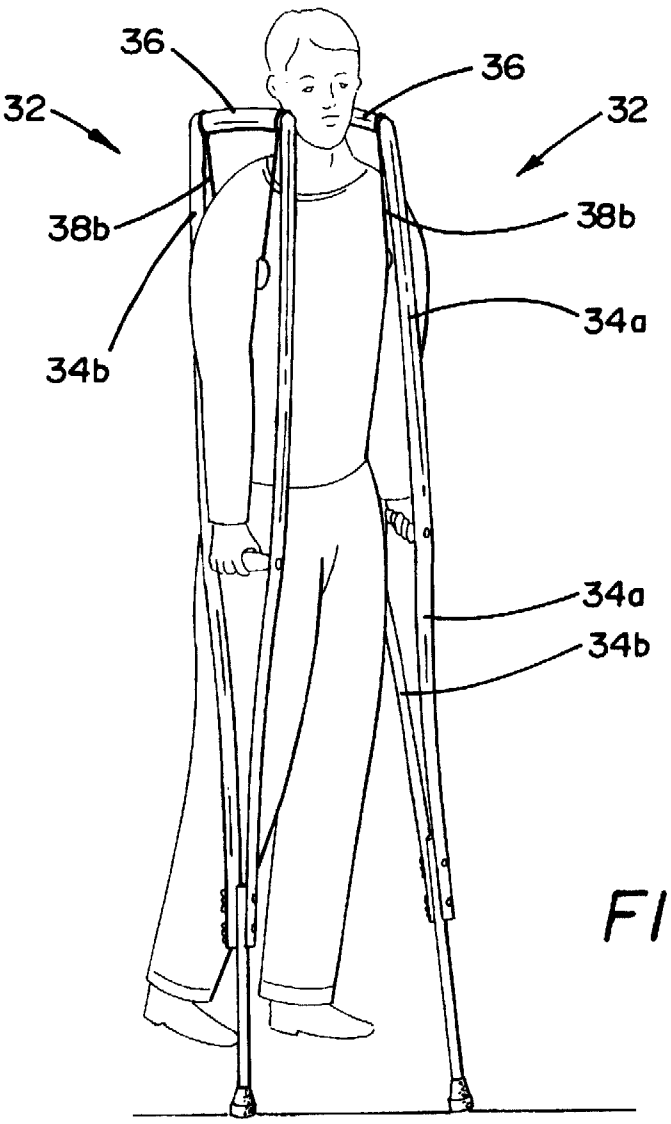
FIG. 4 illustrates the application of the crutches of FIG. 3 to the exercising method.

The mode of using the crutches is clearly depicted in FIG. 4, and need not be explained in further detail.

A selection of a few out of many possible exercises, that will provide significant relief to backache suffering patients, is illustrated in FIGS. 5–12. While the use of the crutches of FIG. 1 is shown, it will be readily appreciated that the same exercises can be performed with the modified crutches of FIG. 3.

Figure 6:
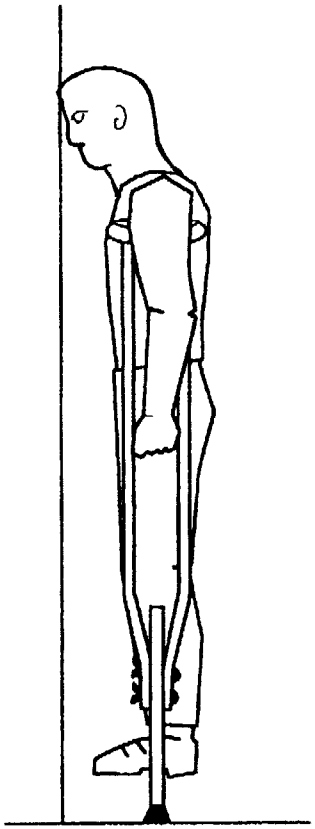
Figure 5:
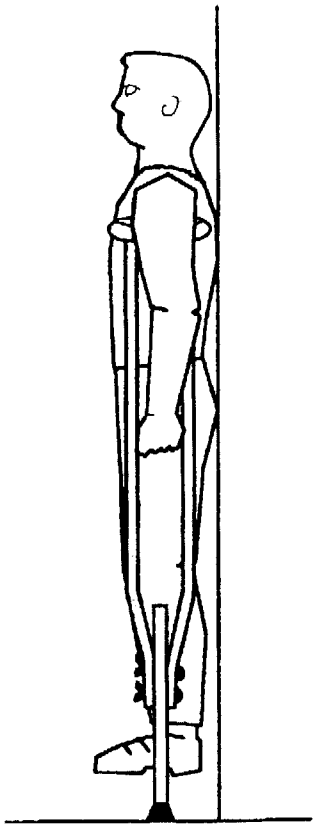

Hence, basic, static exercises are shown in FIGS. 5 and 6, wherein the user just "stands", supporting himself against a wall—once with his back (FIG. 5) and then with aid of his forehead. The weight of the legs and the lower portion of the body will provide the stretching effect of the spinal column, relieving strain from the inter-vertebra joints of the lower back.

The recommended duration of these exercises should not exceed more than 10–30 seconds (for beginners—whether in pain or not).

Figure 7:
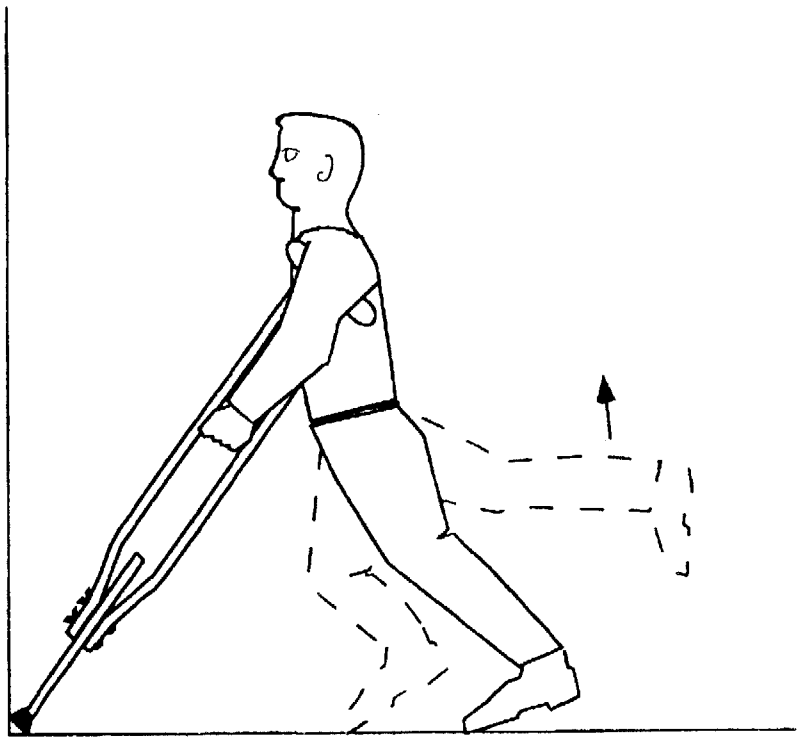
FIGS. 5–12 illustrate a variety of recommended exercises.
Figure 8:
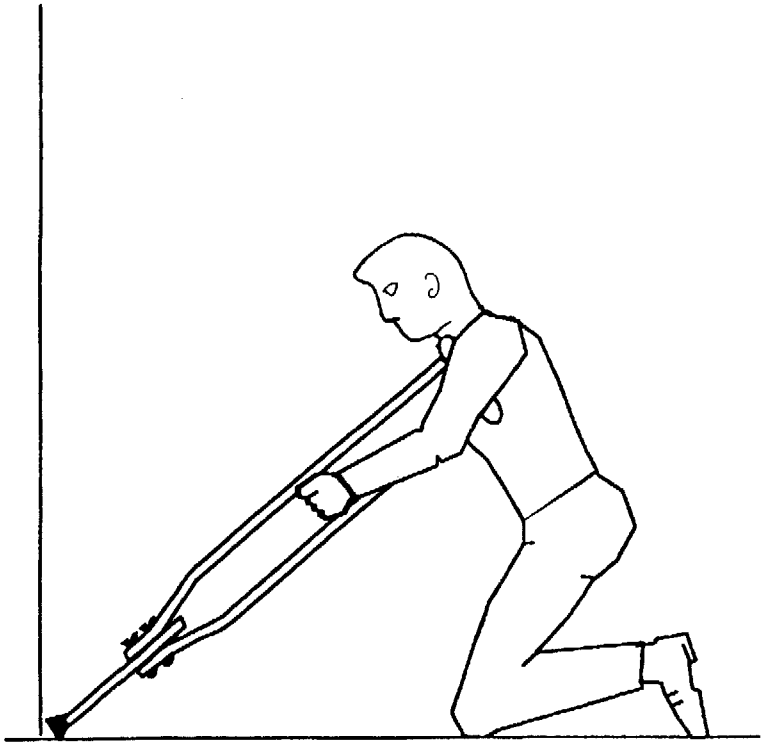

The exercise of FIG. 7 can be performed either as a static one, i.e. leaning in a tilted posture of the body against the crutches (which are preferably supported against slipping as shown)—or dynamically, by bending the knees or lifting one leg at a time backwards; when bending the knees, the position of FIG. 8 can be reached and repeated for several times.

Figure 9:
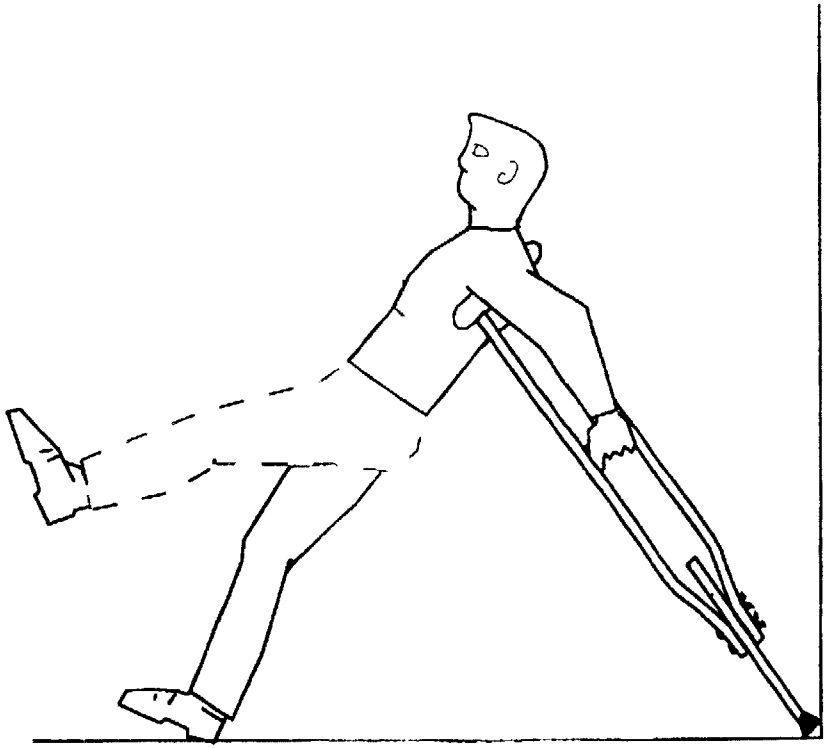

FIG. 9 illustrates a "reversing" exercise, namely leaning backwards on the crutches, possibly with sequentially lifting one and the other of the legs upwards.

Figure 10:
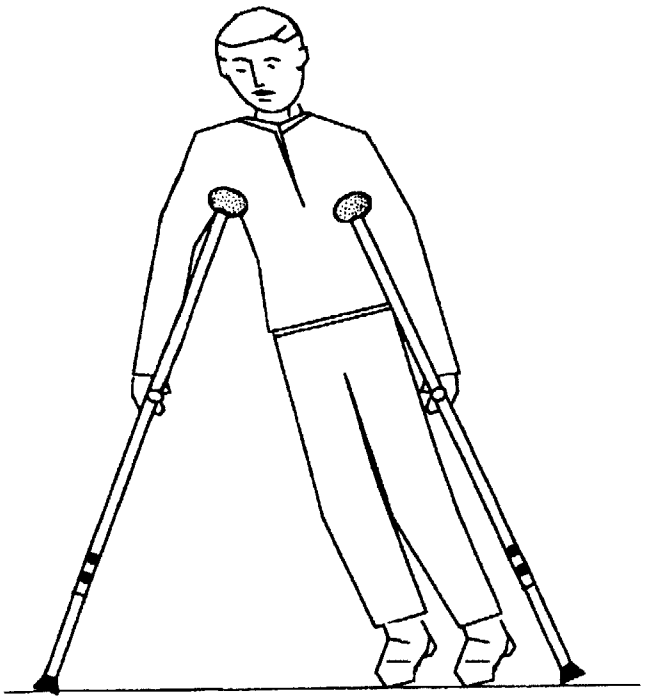

FIG. 10 is a side arching and flexing exercise, especially recommended to those suffering scoliosis and related conditions.

Figure 11:
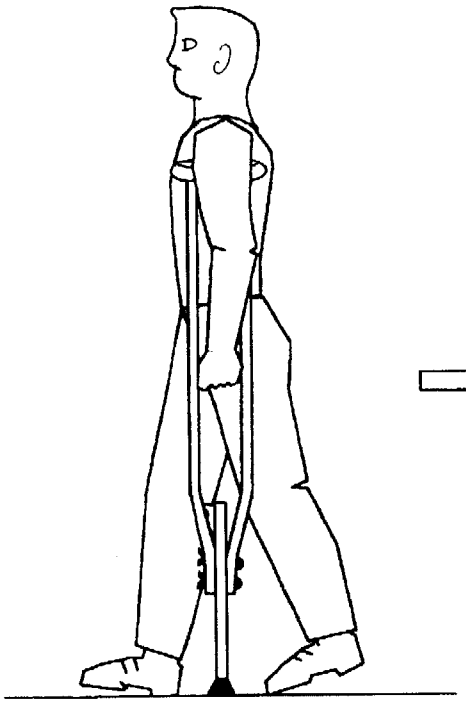

FIG. 11 represents a dynamic exercise. The user performs "walking"-like movements while alternatively lifting and lowering his body, as needed.

Figure 12:
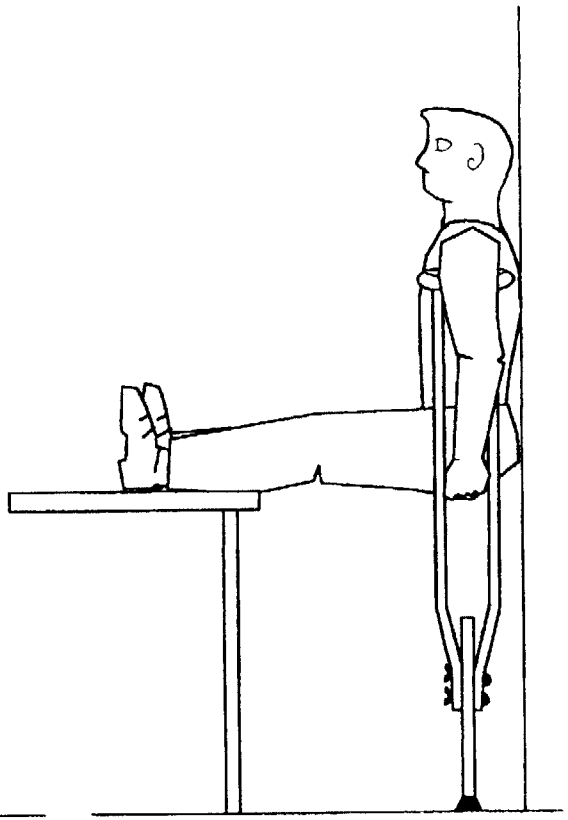

In the exercise illustrated in FIG. 12, the user helps himself by another object (table or the like) to gain control over the effective load (weight) exerted on his spinal column.

The number and versatility of exercises applicable in practicing the method of the present invention has thus been proven, and it is left to the imagination and creativity of the different users to add and/or modify the examples given heretofore.

It will be readily appreciated that the exercising method is of great value not only in curing and possibly avoiding the symptoms of backaches of whatever kind and source, but also in generally contributing to the physical fitness of the user, if practiced on a daily basis.

Those skilled in the art will readily appreciate that numerous changes, variations and modifications may be applied to the invention as above exemplified without departing from scope thereof as defined in and by the appended claims.

What is claimed is:

1. An exercising method comprising the steps of: strengthening the spinal muscles and stretching the spine of a human body by (i) providing a pair of crutches having armpit rests, hand-grips and bases;

(ii) placing the bases of the crutches on a flat surface in an upright position and supporting a patient in a standing, upright position;

(iii) while supporting a patients's body, exercising the patient's body by changing the relative position of the patient's body on the crutches on the one hand and changing the position of the crutches with respect to the flat surface on the other hand and by selectively varying the patient's body weight distribution as supported by the armpit rests, the hand grips, the bases and the patient's legs.

2. The method of claim 1 wherein the exercising includes leaning of the back side of the body against a fixed vertical support.

3. The method of claim 1 wherein the exercising includes leaning of the front side of the body against a fixed vertical support.

4. The method of claim 1 wherein the exercising includes bending the body forwards.

5. The method of claim 1 wherein the exercising includes bending the body backwards.

6. The method of claim 1 wherein the exercising includes bending the body sidewise.

7. The method of claim 1 wherein the exercising includes resting the legs on an elevated support.

* * * * *